US010094354B2

(12) United States Patent
Books et al.

(10) Patent No.: US 10,094,354 B2
(45) Date of Patent: Oct. 9, 2018

(54) DIAGNOSTIC SYSTEM, METHOD, AND APPARATUS FOR A STARTING SYSTEM

(71) Applicant: Cummins, Inc., Columbus, IN (US)

(72) Inventors: Martin T. Books, Columbus, IN (US); Jon S. Wardlow, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 15/192,410

(22) Filed: Jun. 24, 2016

(65) Prior Publication Data

US 2016/0377014 A1 Dec. 29, 2016

Related U.S. Application Data

(60) Provisional application No. 62/186,063, filed on Jun. 29, 2015.

(51) Int. Cl.

| | |
|---|---|
| ***F02N 11/08*** | (2006.01) |
| ***F02D 41/30*** | (2006.01) |
| ***F02N 11/10*** | (2006.01) |

(52) U.S. Cl.

CPC ..... *F02N 11/0848* (2013.01); *F02N 11/0811* (2013.01); *F02N 11/10* (2013.01); *F02D 2250/12* (2013.01); *F02N 11/0818* (2013.01); *F02N 2200/022* (2013.01); *F02N 2200/041* (2013.01)

(58) Field of Classification Search

CPC .... F02D 41/3076; F02D 41/06; F02D 41/062; F02D 19/025; F02D 19/0623; F02D 2250/12; F02N 2250/00; F02N 2200/041; F02N 2200/022; F02N 2011/0874; F02N 11/0811; F02N 11/0848; F02N 11/0851; F02N 11/08; F02N 11/10; F02N 11/00; F02N 11/108

USPC ..... 73/114.25, 114.23

See application file for complete search history.

(56) References Cited

U.S. PATENT DOCUMENTS

| | | | | |
|---|---|---|---|---|
| 4,421,075 A * | 12/1983 | Mandel | F02N 11/0803 | 123/142.5 R |
| 5,979,158 A * | 11/1999 | Kaiser | F01N 3/0835 | 123/179.3 |
| 6,349,710 B1 * | 2/2002 | Kawai | F02D 41/22 | 123/443 |

(Continued)

FOREIGN PATENT DOCUMENTS

| | | |
|---|---|---|
| JP | 4403959 | 11/2009 |
| JP | 2014-109262 | 6/2014 |
| WO | WO-2013/119168 | 8/2013 |

*Primary Examiner* — Lindsay Low
*Assistant Examiner* — George Jin
(74) *Attorney, Agent, or Firm* — Foley & Lardner LLP

(57) ABSTRACT

Diagnosis system, method, and apparatus for a starting system are discloses herein. The method comprises receiving a run condition parameter for a vehicle, receiving a fueling system engagement parameter and an associated time threshold for the fueling system engagement parameter, and receiving an ignition command for turning an engine of the vehicle from an off state to an on state. If the run condition parameter is met, the method receives time data indicative of a time duration from reception of the ignition command to reach or substantially reach the fueling system engagement parameter, compare the time duration to the associated time threshold, and diagnose a starting system of the vehicle based on the comparison.

20 Claims, 4 Drawing Sheets

(56) References Cited

U.S. PATENT DOCUMENTS

| | | | | |
|---|---|---|---|---|
| 7,409,856 | B2 | 8/2008 | Brott et al. | |
| 8,272,360 | B2 | 9/2012 | Hartmann et al. | |
| 2008/0120019 | A1* | 5/2008 | Inoue | B60K 6/445 701/113 |
| 2008/0302176 | A1* | 12/2008 | Friedl | F02D 41/042 73/114.45 |
| 2014/0278020 | A1 | 9/2014 | Neet | |
| 2015/0066338 | A1* | 3/2015 | Howell | F02N 11/0844 701/112 |

* cited by examiner

DIAGNOSTIC SYSTEM, METHOD, AND APPARATUS FOR A STARTING SYSTEM

CROSS-REFERENCE TO RELATED APPLICATIONS

The present application claims the benefit of U.S. Provisional Patent Application No. 62/186,063 entitled "Diagnostic System, Method, and Apparatus for a Starting System," filed on Jun. 29, 2015, which is herein incorporated in entirety by reference.

BACKGROUND

A vehicle typically requires an inertia input to facilitate the starting of the engine. The inertial input is usually provided by a starter motor of a starting system that is electrically powered. The electrically powered starter motor makes it largely independent of the fuel-consuming internal combustion engine, such that the starter motor may be powered whenever there is sufficient electrical energy (e.g., stored by a battery). Accordingly, in use, an operator may turn the ignition key or otherwise close the circuit from the power source to the starter motor. Current is then delivered to the starter motor, which begins to turn. The turning power from the starter motor is delivered to the engine to turn the engine (e.g., rotate the crankshaft). Once the starter motor has reached the predefined engine starting speed, the fueling system for the engine takes over and the starter motor disengages. The engine is then powered by the fuel input.

However, various situations, such as cold engine starts, bad relays, etc., may cause undesirable performance of the starting system, such as delayed starts and non-starts of the engine. It is desirable to identify potential faulty starting systems, or components thereof, in order to facilitate desirable operation of the engine and starting system.

SUMMARY

Various embodiments disclosed herein relate to a starting system diagnostic method, system, and apparatus for a vehicle.

One embodiment relates to an apparatus. The apparatus includes a fueling system engagement circuit structured to receive a fueling system engagement parameter for a vehicle, wherein the fueling system engagement parameter defines an operating condition when a fueling system for the vehicle takes over for a starting system of the vehicle during a transition from an off state to an on state of an engine of the vehicle, and wherein the fueling system engagement parameter includes an associated time threshold. The apparatus also includes a timer circuit structured to receive time data indicative of a time duration for meeting the fueling system engagement parameter, wherein the time duration begins upon the receiving of the ignition command for turning the engine from the off state to the on state. The apparatus further includes a diagnostic circuit structured to compare the time duration to the associated time threshold and responsive to the comparison, diagnose a starting system for the vehicle.

Another embodiment relates to a method. The method includes receiving a run condition parameter for a vehicle; receiving a fueling system engagement parameter and an associated time threshold for the fueling system engagement parameter; receiving an ignition command for turning an engine of the vehicle from an off state to an on state; determining the run condition parameter is met based on reception of vehicle operation data; responsive to the determination that the run condition parameter is met, receiving time data indicative of a time duration beginning at reception of the ignition command to reach or substantially reach the fueling system engagement parameter; comparing the time duration to the associated time threshold; and responsive to the comparison, diagnosing a starting system of the vehicle.

Yet another embodiment relates to a system. The system comprises a controller structured to: receive a run condition parameter for a vehicle; receive a fueling system engagement parameter and an associated time threshold for the fueling system engagement parameter; receive an ignition command for turning an engine of the vehicle from an off state to an on state; determine the run condition parameter is met based on reception of vehicle operation data; responsive to the determination that the run condition parameter is met, receive time data indicative of a time duration from reception of the ignition command to reach or substantially reach the fueling system engagement parameter; comparing the time duration to the associated time threshold; and responsive to the comparison, diagnosing a starting system of the vehicle.

These and other features, together with the organization and manner of operation thereof, will become apparent from the following detailed description when taken in conjunction with the accompanying drawings.

DESCRIPTION OF ILLUSTRATIVE EMBODIMENTS

Figure 1:
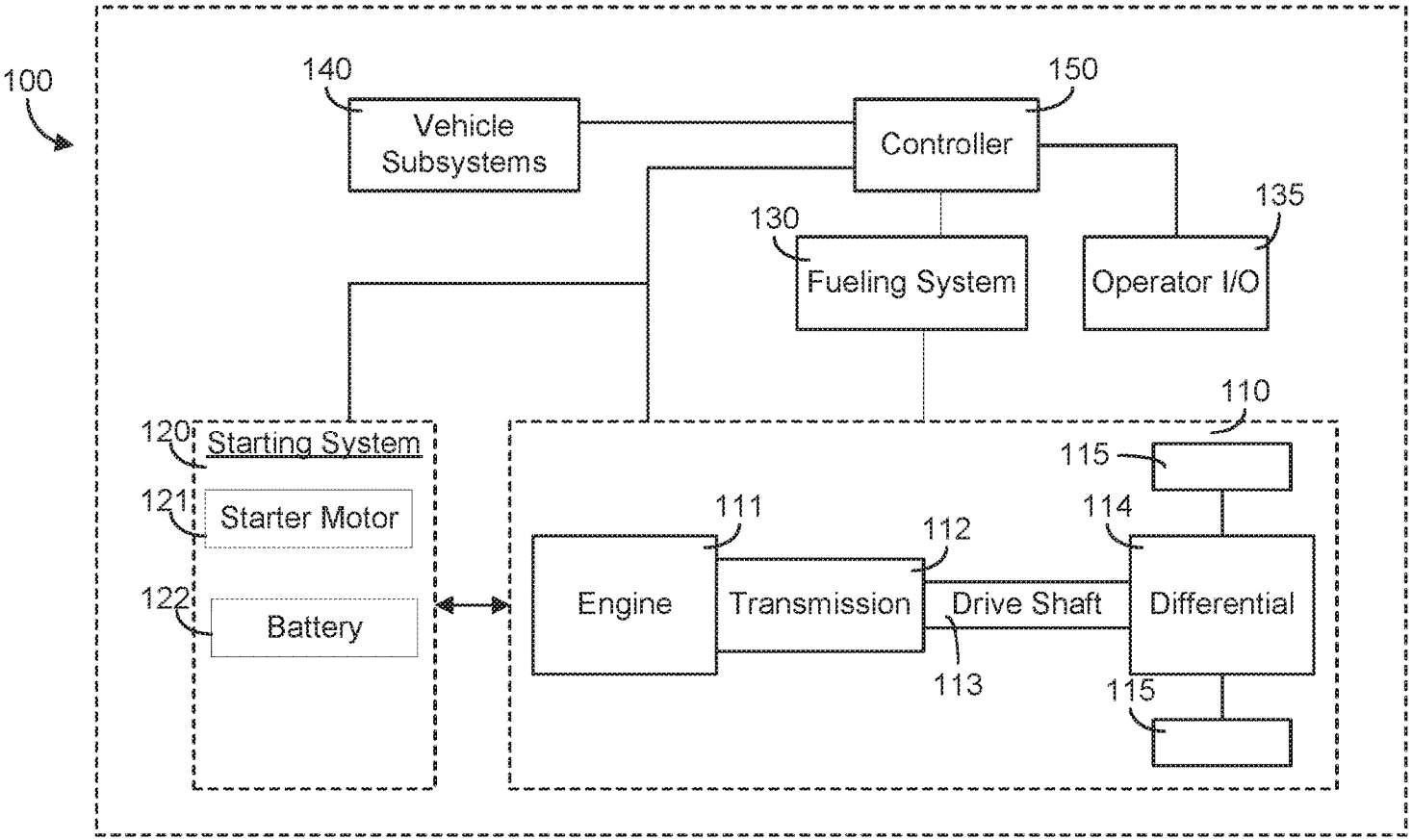
FIG. 1 is a schematic diagram of a vehicle with a controller, according to an example embodiment.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, any alterations and further modifications in the illustrated embodiments, and any further applications of the principles of the disclosure as illustrated therein as would normally occur to one skilled in the art to which the disclosure relates are contemplated herein.

Referring to the Figures generally, the various systems, methods, and apparatuses provided herein relate to the diagnosis of a starting system. The systems, methods, and apparatuses provided herein may be implemented with a starting system of a movable vehicle (e.g., truck, car, bus, boat, airplane, etc.) and/or a stationary device (e.g., a power generator). In operation, a controller receives a run condition parameter that indicates when the diagnostic process is or may be performed. The controller also receives one or more fueling system engagement parameters that define when a fueling system for the vehicle takes over powering the engine from the starting system during engine ignition initiation. Upon receipt of an ignition command and detection of the run condition being met, the controller determines the time duration it takes from the ignition command to meet the fueling system engagement parameter (e.g., an engine speed threshold). The controller may then compare the determined time duration to an associated time threshold for the particular fueling system engagement parameter to diagnose the starting system. For example, if the determined time duration is longer than the time threshold, the controller may determine that the starting system has failed the diagnostic process. The failed (or healthy) diagnosis may be provided to an external network (e.g., a fleet manager, central server, etc.) and/or to an input/output device of the vehicle (e.g., as a fault code or lamp on the dashboard, etc.).

Advantageously, the systems, methods, and apparatuses described herein have provide modularity because they are applicable with many engine-starting system configurations and can be readily adapted to meet each configuration. For example, the engine speed threshold (i.e., fueling system engagement parameter) may change from application-to-application, but this difference may be readily taken into consideration. Moreover, the systems, methods, and apparatuses described herein may beneficially diagnose the starting system without expensive trips to the repair shop. Furthermore, the systems, methods, and apparatuses described herein have the advantage of isolating the diagnosis of only the engine starting hardware (e.g. relays, electric supplies, starter motor) as opposed to other methods that diagnose the entire engine start time up to idle speed where the fuel delivery system has an influence in the outcome. These and other features of the present disclosure are described more fully herein.

Referring generally to FIG. 1, a schematic diagram of a controller communicably coupled to a powertrain system as well as other components in a vehicle is shown according to an example embodiment. The vehicle 100 may be an on-road or off-road vehicle including, but not limited to, cars, trucks, boats, vans, airplanes, or any other type of vehicle that utilizes a starting system. In other embodiments, the vehicle may be replaced by a stationary application, such as a power generator. Accordingly, the vehicle 100 embodiment in FIG. 1 is not meant to be limiting as other configurations are intended to be applicable with the systems, methods, and apparatuses described herein. Referring still to FIG. 1, the vehicle 100 is shown to generally include a controller 150 communicably and operatively coupled to a powertrain system 110, a starting system 120, a fueling system 130, an operator input/output (I/O) device 135, and one or more additional vehicle subsystems 140.

The powertrain system 110 facilitates power transfer from the engine 111 to power the vehicle 100. The powertrain system 110 includes an engine 111 operably coupled to a transmission 112, a drive shaft 113, and a differential 114, where the differential 114 transfers power output from the engine 111 to the final drive (shown as wheels 115) to propel the vehicle 100. As a brief overview, the engine 111 receives a chemical energy input (e.g., a fuel such as gasoline or diesel) from the fueling system 130, and combusts the fuel to generate mechanical energy, in the form of a rotating crankshaft. The transmission 112 receives the rotating crankshaft and manipulates the speed of the crankshaft (i.e., the engine speed, such as revolutions-per-minute (RPM)) to effect a desired drive shaft 113 speed. The rotating drive shaft 113 is received by a differential 114, which provides the rotation energy of the drive shaft 113 to the final drive 115. The final drive 115 then propels or moves the vehicle 100.

The engine 111 may be structured as any internal combustion engine (e.g., compression-ignition or spark-ignition), such that it can be powered by any fuel type (e.g., diesel, ethanol, gasoline, etc.). Similarly, the transmission 112 may be structured as any type of transmission, such as a continuous variable transmission, a manual transmission, an automatic transmission, an automatic-manual transmission, a dual clutch transmission, etc. Accordingly, as transmissions vary from geared to continuous configurations (e.g., continuous variable transmission), the transmission can include a variety of settings (gears, for a geared transmission) that affect different output speeds based on the engine speed. Like the engine 111 and the transmission 112, the drive shaft 113, differential 114, and final drive 115 may be structured in any configuration dependent on the application (e.g., the final drive 115 is structured as wheels in an automotive application and a propeller in an airplane application). Further, the drive shaft 113 may be structured as a one-piece, two-piece, and a slip-in-tube driveshaft based on the application.

The starting system 120 is structured to start and facilitate starting of the engine 111. More particularly, the starting system 120 is structured to turn or power the engine 111 to commence operation of the engine 111 using combustion power (i.e., without or substantially without the use of the starting system 120). An example of operation may be described as follows. Upon receipt of an ignition command (e.g., the turning of an ignition key, the pushing of an ignition button, etc.), the starting system 120 begins cranking or turning the engine. Once the engine is rotating at a predefined engine speed, the fueling system 130 takes over and begins supplying the fuel to power the engine 111 without additional input from the starting system 120.

As shown, the starting system 120 generally includes a starter motor 121 and a battery 122. The starter motor 121 is structured to turn or power the engine 111 upon receipt of an ignition command. Therefore, the starter motor 121 may be structured as any type of starter motor, powered by any of a variety of types of energy, and with any component included, directly or indirectly, with the particular type of starter motor. As such, the starter motor 121 may be configured as: an electrically-powered starter motor such that the battery 122 may provide the energy necessary to power the starter motor; a hydraulically-powered starter motor that receives power from or via one or more hydraulic systems of the vehicle; a pneumatically-powered starter motor 121 that receives power from or via one or more pneumatic systems of the vehicle; etc. Accordingly, based on the power-source, the starting system 120 may include any component that provides and facilitates power transfer from the power source to the starter motor 121. For example, in regard to the pneumatic starter motor, the starting system may include an air compressor, an accumulator tank, one or valves, and piping that fluidly couples the components of the pneumatic starting system. In another example, in regard to the hydraulic starter motor, the starting system may include one or more pumps, filters, valves, accumulator tanks, and piping to fluidly couple the components. In certain embodiments, more than one type of starting system may be used with the vehicle, such as for a back-up in the case of emergency situations (e.g., a hydraulic starter to back-up the primary electric starter motor).

In the example depicted, the starter motor 121 is structured as an electrically-powered starter motor 121. The starter motor 121 may be structured as any type of electrically-powered starter motor including, but not limited to, a gear-reduction starter motor, an inertia starter motor, a pre-engaged starter motor, etc. More particularly, the type of starter motor 121 may then include a permanent-magnet starter motor, a series-parallel direct current starter motor, etc. In operation, upon receipt of an ignition command, the battery 122 (or other electrical energy source) provides electrical energy to the starter motor 121. In this embodiment, the starter motor 121 may include or be electrical coupled to a starter solenoid that, upon receipt of the current, actuates a drive pinion of the starter motor 121 to engage with the engine (e.g., a coupling such as a ring gear of a flywheel) to turn or power the engine 111. The solenoid may also act like a switch to permit the current to flow to the starter motor 121 to power the starter motor 121. Thus, upon receipt of the ignition command, electrical current from the battery 122 is provided to the solenoid, which causes the solenoid to close and permit current to flow to the motor 121 and which also causes the drive gear or drive pinion of the starter motor 121 to actuate to engage with a mating feature of the engine 111. The high current produces a high torque from the starter motor 121 to turn the mating feature (e.g., flywheel) and, in turn, the engine 111. After the fueling system 130 takes over and the engine speed is at or above a speed threshold for the starter motor 121, to prevent or substantially prevent the engine 111 from driving the starter motor 121, an overrunning clutch (e.g., one-way bearing, one-way torque transmitting device, sprag clutch, etc.) may be included with the starter motor 121.

While some of the components described above are in regard to the electrically-powered starter motor 121 (e.g., overrunning clutch), it should be understand that more, fewer, or different components than these components may also be included with other starter motor types. Therefore, just because the above description is primarily in regard to an electrically-powered starter motor, this description is not intended to be limiting.

The fueling system 130 is structured to provide fuel to the engine 111. In one embodiment, the fueling system 130 provides the fuel after the starting system 120 has brought the engine speed up to a predefined threshold. The fueling system 130 may include any component that may be included in a fueling system 130, such as one or more fuel injectors, spark plugs, electrical wires, a power source (such as the battery 122), fuel supply and providing lines, sensors (e.g., fuel flow sensors, fuel tank capacity sensors), fuel tank(s), and so on.

The operator I/O device 135 enables an operator of the vehicle to communicate with the vehicle 100 and the controller 150. For example, the operator I/O device 135 may include, but is not limited, an interactive display (e.g., a touchscreen, etc.), an accelerator pedal, a clutch pedal, a shifter for the transmission, a cruise control input setting, etc. Via the input/output device 135, the operator can designate one or more preferred characteristics of one or more parameters, such as a fuel system engagement parameter that indicates when the fueling system 130 is to take over for the starting system 120. The controller 150 can also provide commands/instructions/information to the operator (or a passenger) via the input/output device 135 (e.g., inspection of the starting system needed).

As also shown, the vehicle 100 includes one or more vehicle subsystems 140. The various vehicle subsystems 140 may generally include one or more sensors (e.g., a speed sensor, torque sensor, intake manifold pressure sensor, ambient pressure sensor, temperature sensor attached to the engine, etc.), as well as any subsystem that may be included with a vehicle. Accordingly, the subsystems 140 may also include an exhaust aftertreatment system. The exhaust aftertreatment system can include any component used to reduce diesel exhaust emissions, such as selective catalytic reduction catalyst, a diesel oxidation catalyst, a diesel particulate filter, a diesel exhaust fluid doser with a supply of diesel exhaust fluid, and a plurality of sensors for monitoring the aftertreatment system (e.g., a NOx sensor). In this regard, the exhaust aftertreatment system is structured to receive the exhaust from the combustion process in the engine 111 and reduce the emissions from the engine 111 to less environmentally harmful emissions (e.g., reduce the NOx amount, reduce the emitted particulate matter amount, etc.).

The controller 150 is communicably coupled to the powertrain system 110, the starting system 120, the fueling system 130, the operator I/O device 135, and the one or more vehicle subsystems 135. Communication between and among the components may be via any number of wired or wireless connections (e.g., any standard under IEEE 802, etc.). For example, a wired connection may include a serial cable, a fiber optic cable, an SAE J1939 bus, a CAT5 cable, or any other form of wired connection. In comparison, a wireless connection may include the Internet, Wi-Fi, Bluetooth, Zigbee, cellular, radio, etc. In one embodiment, a controller area network (CAN) bus including any number of wired and wireless connections provides the exchange of signals, information, and/or data. Because the controller 150 is communicably coupled to the systems and components in the vehicle 100 of FIG. 1, the controller 150 is structured to receive data (e.g., instructions, commands, signals, values, etc.) from one or more of the components shown in FIG. 1.

Further, as the components of FIG. 1 are shown to be embodied in a vehicle 100, the controller 150 may be structured as an electronic control unit (ECU), such as an engine control circuit. The ECU may include a transmission control unit and any other control unit included in a vehicle (e.g., exhaust aftertreatment control unit, powertrain control circuit, etc.). The function and structure of the controller 150 are shown described in greater detail in FIG. 2.

Figure 2:
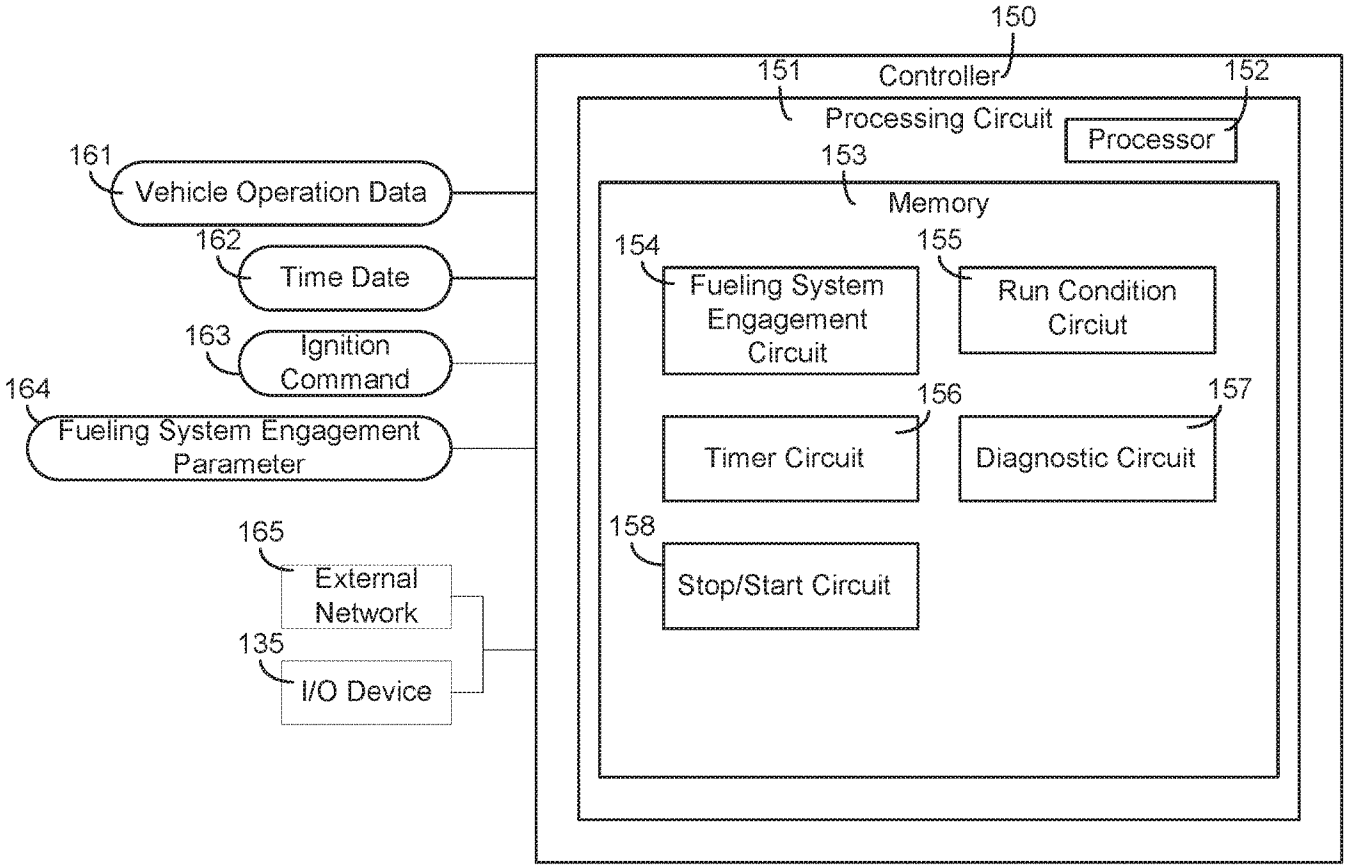
FIG. 2 is a schematic diagram of the controller of FIG. 1, according to an example embodiment.

Accordingly, referring now to FIG. 2, the function and structure of the controller 150 are shown according to one example embodiment. The controller 150 is shown to include a processing circuit 151 including a processor 152 and a memory 153. The processor 152 may be implemented as a general-purpose processor, an application specific integrated circuit (ASIC), one or more field programmable gate arrays (FPGAs), a digital signal processor (DSP), a group of processing components, or other suitable electronic processing components. The one or more memory devices 153 (e.g., RAM, ROM, NVRAM, Flash Memory, hard disk storage, etc.) may store data and/or computer code for facilitating the various processes described herein. Thus, the one or more memory devices 153 may be communicably connected to the controller 150 and provide computer code or instructions to the controller 150 for executing the processes described in regard to the controller 150 herein. Moreover, the one or more memory devices 153 may be or include tangible, non-transient volatile memory or non-volatile memory. Accordingly, the one or more memory devices 153 may include database components, object code components, script components, or any other type of information structure for supporting the various activities and information structures described herein.

The memory 153 is shown to include various circuits for completing the activities described herein. More particularly, the memory 153 includes circuits a fueling system engagement circuit 154, a run condition circuit 155, a timer circuit 156, a diagnostic circuit 157, and a start/stop circuit 158. The circuits are configured to selectively perform a diagnostic process on the starting system 120 and, responsive to the results of the diagnostic process, diagnose the starting system 120. While various circuits with particular functionality are shown in FIG. 2, it should be understood that the controller 150 and memory 153 may include any number of circuits for completing the functions described herein. For example, the activities of multiple circuits may be combined as a single circuit, as additional circuits with additional functionality may be included, etc. Further, it should be understood that the controller 150 may further control other vehicle activity beyond the scope of the present disclosure.

Certain operations of the controller 150 described herein include operations to interpret and/or to determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

The fueling system engagement circuit 154 is structured to receive a fueling system engagement parameter 164. Accordingly, in one embodiment, the fueling system engagement circuit 154 may include the fuel system 130 and any associated fuel system 130 controller for receiving the fueling system engagement parameter 164 for the fuel system 130. In another embodiment, the fueling system engagement circuit 154 may be communicably coupled to the operator I/O device 135 for receiving the fueling system engagement parameter 164 and providing it to the fuel system 130 controller for use. In yet another embodiment, the fueling system engagement circuit 154 may be structured as the fueling system controller for the fuel system 130, such that receipt of the fueling system engagement parameter 164 may be readily implemented with the fuel system 130 using the controller 150. In certain embodiments, the fueling system engagement circuit 154 may have one or more fueling system engagement parameters 164 predefined and stored.

The fueling system engagement parameter 164 generally refers to when the fueling system 130 takes over for the starting system 120 for the engine 111 during ignition initiation of the engine 111. That is to say, the fueling system engagement parameter 164 refers to when disengagement of the starting system 120 occurs, or when the engine is operating at a condition that does not or substantially does not require use of the starting system 120 anymore. The fueling system engagement parameter 164 may also include an associated time threshold, where the associated time threshold defines a threshold time duration or range for when the particular fueling system engagement parameter should be met, substantially met, and/or is desired to be met upon receipt of the ignition command (i.e., during the ignition process). The acceptable time durations may vary based on the associated fueling system engagement parameter 164.

Accordingly, the fueling system engagement parameter 164 may include a predefined engine speed. The predefined engine speed may vary from application-to-application (e.g., a low-duty diesel engine application to a heavy duty diesel engine application) and generally refers to an engine speed that is sufficient or deemed to be sufficient to sustain combustion where the fueling system 130 can take over powering the engine 111. In one embodiment, the engine speed corresponds with any engine speed between approximately 150 RPM and 200 RPM. In an example, for a diesel engine used in a semi-tractor trailer application, the predefined engine speed may be 200 RPM. In turn, the associated time threshold may include a desired time duration to reach the predefined engine speed from receiving the ignition command.

In another embodiment, the fuel system engagement and starter motor operation may overlap and the predefined engine speed corresponds to a point where their relative influences on engine speed can be thought of as reversing (i.e., starter motor torque diminishes with increasing engine speed and torque from engine fueling increases with engine speed). Thus, in some embodiments, an indication of the reverse operation may be used as the fueling system engagement parameter 164.

Another fueling system engagement parameter 164 may be a predefined starter motor 121 speed, where at or above the predefined starter motor speed the starter motor disengages and the fueling system 130 takes over. The starter motor speed may be based on a speed sensor operatively coupled to the starter motor 121. In turn, the associated time threshold may include a desired time duration to reach the predefined starter motor speed from receiving the ignition command.

Still another fueling system engagement parameter 164 may be when the controller 150 references a fueling system controller. The fueling system controller may dictate the timing, quantity, and location of fuel injection for a fuel-injected engine. In some embodiments, the fueling system controller may be included with the controller 150. Accordingly, if the fueling controller has not yet commanded fuel, then the controller 150 may determine that the fueling system 130 is not yet engaged. Referencing of the fueling system controller may be based on one or more operating conditions of the vehicle, such as engine speed. For example, if the engine speed is between approximately 150 RPM and 200 RPM, then the switch is going to occur. Thus, defining the switch may be based on one or more operating conditions and/or the switch itself. Accordingly, the associated time threshold may include a desired time duration from receiving the ignition command for the switch to the fueling system controller to occur.

Yet another fueling system engagement parameter 164 may include a disengagement condition for the starter motor 121. The disengagement condition may be based on an engine speed at or above a maximum speed of the starter motor 121 (as described above) and/or when the overrunning clutch on the starter motor 121 begins freewheeling. In regard to the latter condition, the fueling system engagement parameter 164 may include a torque and/or a speed indicative of an onset of a freewheeling condition for the overrunning clutch. Accordingly, in use, when an engine torque and/or speed sensor detects a speed or torque that is at or above the overrunning condition (i.e., when the clutch would freewheel and not transmit torque from the engine to the motor), then the diagnostic circuit 157 may determine that the fueling system 130 is engaged (i.e., fueling is occurring to power the engine 111) and the starting system 120 is no longer engaged.

It should be understood that the above list of fueling system engagement parameters 164 is not meant to be limiting as other fueling system engagement parameters indicative of when the fueling system 130 engages with the engine 111 (or, conversely, when the starting system 120 disengages from powering the engine 111) may be used. Further, certain embodiments may utilize more than fueling system engagement parameter 164 collectively in the diagnostic process for the starting system 120.

The run condition circuit 155 is to receive a run condition that defines when the diagnostic process is performed. In other words, the run condition may define when the timer circuit 156 and/or diagnostic circuit 157 is activated. Accordingly, performance of the diagnostic process may be conditioned on the run condition being detected or present.

One run condition may be that the diagnostic process is only run when an engine temperature is at or above a certain threshold. In this regard, cold engine starting is substantially excluded from the diagnostic process. Because a cold engine typically corresponds with a relatively higher viscosity of the fluids (e.g., oil), a cold engine start may require relatively more time to start than what is typically needed. As such, cold engine starting may be a bad or relatively worse operating condition for using the diagnostic procedure described more particularly herein in regard to the timer circuit 156 and the diagnostic circuit 157.

Another run condition may be when the battery (or other energy supply source for the starter motor), such as battery 122, has a charge level at or above a predefined threshold. For example, low charge or a drained battery may have a difficult time of providing the current necessary to start the engine in a satisfactory amount of time. Accordingly, the diagnostic procedure of the present disclosure may be inapplicable during this condition.

Yet another run condition may be an environment condition, such as an ambient air temperature and/or pressure. If the temperature and/or pressure is below a certain value or threshold, the starting system may be burdened more than a typical amount, such that the results of the diagnostic process may be inapplicable. That is to say, the diagnosis may be a fail condition, but this is due to one or more environmental conditions that strain the starting system 120 and not due to a faulty component(s) of the starting system 120.

It should be understood that the above-noted run conditions list not meant to be limiting as other run conditions that indicate when a debilitating circumstance is not present may also be utilized (e.g., oil temperature above a certain threshold, etc.).

The one or more run conditions may be determined to be present based on received operation data 161 by the run condition circuit 155. The operation data 161, also referred to as vehicle operation data, may include but is not limited to, a vehicle speed, a current transmission gear/setting, a load on the vehicle/engine, a throttle position, whether a start/stop operating mode is active, data relating to one or more of the vehicle subsystems 140, an output power, an engine speed, a characteristic of the battery (e.g., charge level), a characteristic of the starting system 120 (e.g., starter motor speed, etc.), a fluid consumption rate (e.g., fuel consumption rate, diesel exhaust fluid consumption rate, etc.), any received engine/vehicle faults (e.g., a fault code indicating a low amount of diesel exhaust fluid), engine operating characteristics, etc. In this regard and in certain embodiments, the run condition circuit 155 may include one or more sensors operable to acquire the aforementioned data, such as temperature sensors, flow sensors, pressure sensors, speed sensors, fluid level sensors, oxygen sensors, mass air flow sensors, and the like.

Responsive to receipt of an ignition command 163, the timer circuit 156 is structured to determine a time duration to meet the fueling system engagement parameter 164. Accordingly, the timer circuit 156 may include a timer or other duration tracking device. In another embodiment, the timer circuit 156 may receive time data 162 indicative of the time duration. As mentioned above, activation of the timer circuit 156, in one embodiment, may be based on satisfaction of one or more run conditions.

The ignition command 163 refers to any command that is structured to start the engine 111 (i.e., turn the engine from an off state to an on state). Accordingly, the ignition command may include, but is not limited to, actuation of an ignition key, actuation of an ignition button (via a remote actuation controller or on the vehicle itself), and any other command that is configured to start the engine 111. The ignition command 163 may be via user input, such as the turning of the key, or substantially without user input, such as the release of a brake pedal during engine start/stop operating mode (described below). All such variations are intended to fall within the spirit and scope of the present disclosure.

Based on the determined time it takes to reach or meet the fueling system engagement parameter 164, the diagnostic circuit 157 is structured to determine whether the starting system 120 is faulty or not (e.g., needs to be serviced, checked, replaced, etc.). Accordingly, the diagnostic circuit 157 may include communication circuitry that communicably couples the diagnostic circuit 157 to the other circuits and/or to one or more components in the vehicle, such as the starting system 120. For example, if the fueling system engagement parameter is a predefined engine speed and if the time it takes to reach the predefined engine speed is at or beyond an associated and predefined time threshold, the diagnostic circuit 157 may determine that the starting system 120 is faulty. Accordingly, the diagnostic circuit 157 may compare the determined time to reach the one or fueling system engagement parameters 164 with the associated time threshold. If the elapsed time is greater than an acceptable time duration, then the diagnostic circuit 157 may diagnose the starting system 120 as faulty (or simply that the starting system 120 has failed the diagnostic).

Meeting or substantially meeting the fueling system engagement parameter 164 is highly configurable. For example, the fueling system engagement parameter may be considered met or substantially met if it is within a certain amount, percentage, or the like of a threshold value. In other examples, the fueling system engagement parameter may only be considered met if the parameter exists for more than a predefined amount of time. For example, if the fueling system engagement parameter is engine speed and during the ignition process, the engine speed surpasses the predefined threshold, the diagnostic circuit 157 may determine that the starting system 120 passes the diagnostic process. However, due to a setting, the engine speed must be at or above the threshold for more than a predefined amount of time and, in the current example, the engine speed has dipped down below the threshold within the predefined time frame. Accordingly, the diagnostic circuit 157 may determine that the starting system 120 has failed the diagnostic process. Of course, as one of ordinary skill in the art will appreciate, the precise delineations of what is considered met or substantially is highly variable, with all such variations intended to fall within the spirit and scope of the present disclosure.

As mentioned above, the diagnostic circuit 157 may include confirmation logic that confirms the diagnosis of the starting system 120. The confirmation logic may prescribe that a predefined number of "fails" must occur before the diagnostic circuit 157 determines that the starting system 120 is faulty. The predefined number of fails may need to be consecutive (e.g., five consecutive fails) or spread out of a predefined duration of time (e.g., five fails over the past week). The confirmation logic may reset based on receipt of service or replacement of one or more features in the starting system 120.

Based on the diagnosis determination, the diagnostic circuit 157 is structured to provide the diagnosis to at least one of an external network 165 and the I/O device 135. Accordingly, the diagnostic circuit 157 may include communication circuitry for providing the diagnosis to at least one of the external network 165 and the I/O device 135. The communication circuitry may include wired and/or wireless protocols as described above (e.g., a CAN bus, etc.). The diagnosis provided to the I/O device 135 may be in the form of a lamp (e.g., a check engine light) with a fault code, a dashboard screen indicator, and/or any other type of indicator provided to an operator or passenger in the vehicle.

The external network 165 refers to a third-party location relative to the vehicle 100 itself. Accordingly, the external network 165 may include a central server, database, fleet manager, traffic center, a cloud based server, and so. In some embodiments, the external network 165 may include another vehicle. As such, an intelligent transportation system (ITS) (e.g., vehicle-to-vehicle communication and/or vehicle-to-server, generally referred to as vehicle-to-X communication) may be established from the exchange of data, signals, values, information, and the like between the vehicle 100 and at least one of another vehicle and/or a different external network. The central server or other fleet manager may compile the determined faulty starting systems (and healthy starting systems) to further analyze the data. For example, along with the diagnosis, the fleet manager may also receive vehicle operation data indicative of the operating conditions of the vehicle when the engine was started (or restarted).

Based on the above, an example operation of the controller 150 is as follows. An operator for the vehicle turns the key of the vehicle 100 to start the engine 111. Because the engine temperature is above a certain threshold (i.e., the run condition), the timer is activated. Assuming for this instance the fueling system engagement parameter is a predefined starter motor speed, the timer tracks the length of time it takes to reach the predefined starter motor speed. If the time duration is greater than or equal to an acceptable threshold of time, then the diagnostic circuit 157 may determine that the starting system 120 is faulty. In other embodiments, the diagnostic circuit 157 may command the diagnostic process to be run at the next four engine starts before making a determination. If faulty or healthy is the determined diagnosis, the diagnostic circuit 157 may provide this diagnosis to a desired location (e.g., the external network and/or I/O device).

As briefly mentioned above, the vehicle operation data 161 may include an indication of a stop/starting operating mode for the vehicle 100. The stop/start operating mode refers to selectively shutting the engine 111 down and then selectively re-starting the engine 111, where the stopping and starting of the engine 111 typically occurs in short time durations (e.g., less than two minutes). For example, if the vehicle 100 is in line at a restaurant drive-thru but stuck behind several vehicles that are not moving, because the vehicle 100 is also not moving, then the stop/start circuit 158 may turn the engine 111 off. When the operator releases the brake pedal, the stop/start circuit 158 facilitates re-ignition of the engine 111. Engine stop/start may be used to conserve fuel. For example, during periods of engine idle, rather than maintaining fueling, the engine can be shut off to conserve fuel. Thus, the stop/start circuit 158 may include a stop/start device that selectively initiates and turns off the engine of the vehicle. In other embodiments, the stop/start circuit 158 may include communication circuitry that provides one or more commands to the starting system 120, engine 111, and various other components to selectively start/stop the vehicle 100.

The precise delineations of when the engine 111 is turned off and when it is restarted are highly configurable. For example, if the brake pedal is depressed for more than a predefined threshold of time, such as thirty (30) seconds, the stop/start circuit 158 turns the engine 111. In another example, if the vehicle has been coasting for more than a predefined amount of time, such as the past thirty (30) seconds, the stop/start circuit 158 may turn the engine 111 off and rely on vehicle momentum to propel the vehicle 100. In regard to restarting the engine, the ignition command 163 may include a voice command from the driver (e.g., start the engine now), a button or other type key actuation, depression of the accelerator pedal, release of the brake pedal, movement of the shifting device outside of a neutral position, etc. In this regard, the ignition command 163 may be via an indirect call for ignition relative to the typical "turn the key" command. As such, the ignition command 163 may stem from the controller 150 itself based on one or more operating conditions, rather than from an operator (such as via a turn of the key from the operator).

There may also be a redundancy feature included with the start/stop circuit 158. The redundancy feature is structured to confirm whether the engine 111 may be turned off/on. For example, a predefined turn off condition may be detected and in response to the detection, the stop/start circuit 158 provides an alert to the I/O device 135 asking the operator to confirm whether or not the engine 111 may be turned off. In this regard, the redundancy feature may substantially prevent undesired engine stops and/or starts.

According to one embodiment, the diagnostic process described above may also be applicable during the engine start/stop operating mode. Because engine restart is a prime concern for the efficacy of the stop/start mode, diagnosing the starting system 120 may be continuously determined to ensure or substantially ensure that the stop/start mode can be continually utilized. Thus, the diagnostic systems and methods of the present disclosure may be used as a protective measure for starting systems used in engine stop/start vehicles.

Figure 3:
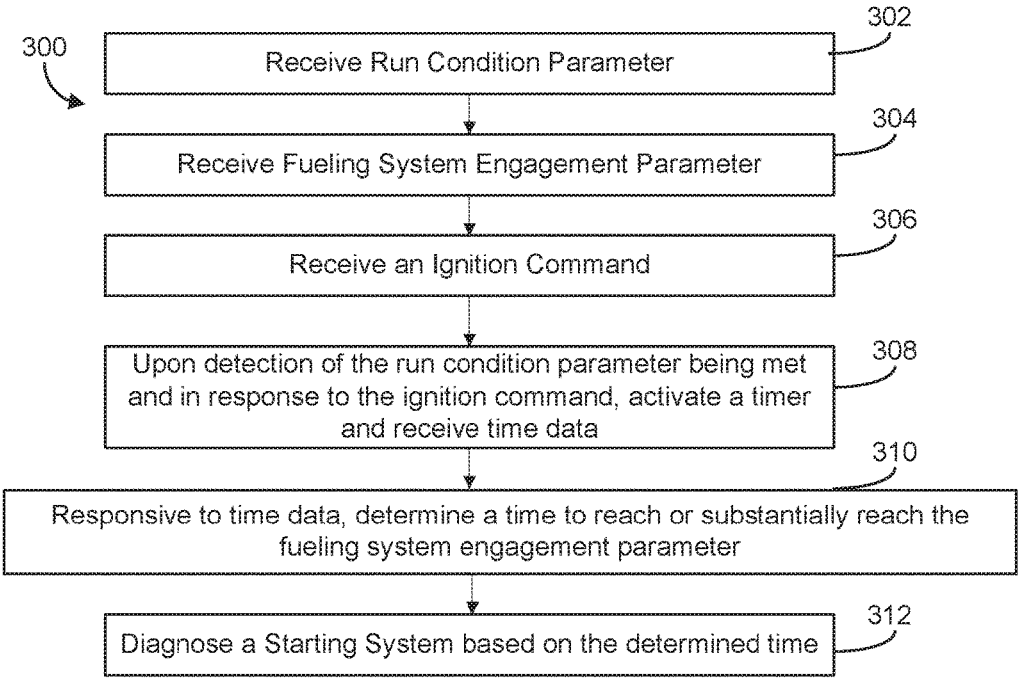
FIG. 3 is a flow diagram of a method of diagnosing a starting system for a vehicle, according to an example embodiment.

Referring now to FIG. 3, a flow chart of a method 300 of diagnosing a starting system of a vehicle is shown, according to an exemplary embodiment. The method 300 may be implemented using controller 150 of FIGS. 1-2. Accordingly, method 300 is described with reference to FIGS. 1-2.

At process 302, a run condition parameter is received. The run condition parameter defines when (i.e., under what operating conditions) the remainder of the process 300 should be performed. As mentioned above, the run condition parameter may correspond with one or more vehicle, engine, and/or environmental conditions that indicate that the remainder of the diagnostic process 300 may performed. The one or more vehicle operating conditions may include, but are not limited to, an oil temperature above a certain threshold, a coolant temperature (at a predefined location) above a certain threshold, a battery charge level within a predefined range or at or above a predefined threshold, etc. The one or more engine operating conditions may include, but are not limited to, an engine temperature at or above a predefined threshold (or within a certain range), etc. The one or more environmental conditions may include, but are not limited to, an ambient temperature or pressure in a predefined ranged and/or at or above a predefined threshold, an altitude level of the vehicle that is within a predefined range, etc. Further, the run condition parameter may also include a user-defined run condition. The user-defined run condition may further dictate or define implementation of the process 300. The user-defined run condition may include, but is not limited to, performing the process 300 every "Xth" time the engine is started (e.g., run the process every time the engine is started, run the process every other time the engine is started, run the process every tenth time the engine is started), performing the process after a predefined time duration (e.g., run the process once per week when the one or more of the above-named conditions are met, run the process monthly, etc.), on-demand where the user specifically calls for the running of the processing 300, conditional on the results of the process 300 (e.g., if a fail diagnosis is received, then run the process for each of the next five engine starts to confirm the accuracy of the diagnosis but if a pass diagnosis is received, then continue with the periodic performance of the process 300, etc.), etc.

It should be noted that the aforementioned list of user-defined run condition parameters and vehicle, engine, and environmental run condition parameters is not meant to be limiting. Further, the run condition parameters may be used alone or in combination with other predefined run condition parameters to determine when the remainder of the process 300 is performed. Moreover, other embodiments may only use vehicle, engine, and environmental run condition parameters; or, alternatively, only user-defined run condition parameters. Thus, as those of ordinary skill in the art will readily appreciate, the precise implementation of the run condition parameters used for each application may vary greatly based on the application. For example, a light duty spark-ignition engine may have a different run condition engine temperature parameter than a heavy duty compression-ignition engine. In another example, the light duty spark-ignition engine may only use ambient air and pressure temperature as its run condition parameter while the heavy duty compression-ignition engine uses only engine temperature. Accordingly, the above-noted examples are not meant to be limiting as many other configurations are possible, with all such variations intended to fall within the spirit and scope of the present disclosure.

At process 304, a fueling system engagement parameter is received. Along with the fueling system engagement parameter, an associated time threshold for the particular fueling system engagement parameter may also be received, where the time threshold prescribes an acceptable amount of time for reaching the fueling system engagement parameter after reception of the ignition command. As mentioned above, the fueling system engagement parameter refers to one or more conditions indicative of when the fueling system (e.g., fueling system 130) takes over powering the engine for the starting system. Accordingly, the fueling system engagement parameter may include, but is not limited to, a predefined engine speed, a predefined starter motor speed, when the controller references a fueling system controller, when the overrunning clutch on the starter motor 121 begins freewheeling, etc.

At process 306, an ignition command for a starting system of the vehicle is received. The ignition command refers to any command intended to facilitate the starting of the engine. The ignition command may be with or without user or operator input. With operator input refers to the operator actually initiating ignition of the engine. For example, the operator may turn the ignition key, press the ignition button, etc. Without operator input refers to the vehicle detecting one or more operating conditions and automatically or substantially automatically initiating ignition of the engine in response to the detected conditions. For example, during the engine stop/start operating mode, the controller may detect that the user has released the brake pedal and, in response, provides a command to the starting system to begin re-ignition of the engine. While the controller may have used a cue from the operator (e.g., the release of the brake pedal), the ignition of the engine is largely without user input. In this regard, the command to the starting system comes directly from the controller 150 rather than the ignition or button key ignition terminal (e.g., from a user completing the ignition circuit by turning the key or pushing the button).

At process 308, upon detection of the run condition parameter being met and in response to receiving the ignition command, a timer is activated. Determination that the run condition parameter is met may via received or acquired vehicle operation data and/or from an explicit input from the operator or user. The timer may be included with the timer circuit 156 or communicably coupled to the timer circuit 156 and is structured to begin a counter beginning at or nearly at receipt of the ignition command. The controller 150 then receives time data, which refers to the time duration measured, determined, estimated, counted, etc. from receipt of the ignition command.

At process 310, responsive or based on the time data, a time to reach or substantially reach the predefined fueling system engagement parameter is determined.

At process 312, based on the determined time, the starting system is diagnosed. In this regard, the determined time may be compared to a predefined threshold of time associated with the fueling system engagement parameter. Thus, process 312 may include a comparison step. In one embodiment, the comparison step is implemented as a look-up table in the controller 150 to facilitate quick determinations. In other embodiments, the comparison step is implemented with the controller 150 in any possible way (e.g., algorithms, formulas, models, etc.) that facilitate diagnosis of the starting system. If the determined time meets the threshold, then the diagnosis may be healthy. If the determined time fails to meet the threshold, then the diagnosis may be failed. Of course, these diagnosis are exemplary only. In this regard, while the diagnosis may be binary, such as pass or fail, the diagnosis may also be relatively more nuanced, such as "pass-but monitor" versus "pass-no monitoring needed" and so on. For example, based on how close the determined time is to the time threshold associated with the predefined fueling system engagement parameter, different gradations or variations of the diagnosis may be determined (e.g., if the time is below the threshold by 0.01 seconds or less, then it is pass-but monitor, and if it is below the threshold by more than 0.05 seconds, then it is pass-no monitoring needed, etc.).

Figure 4:
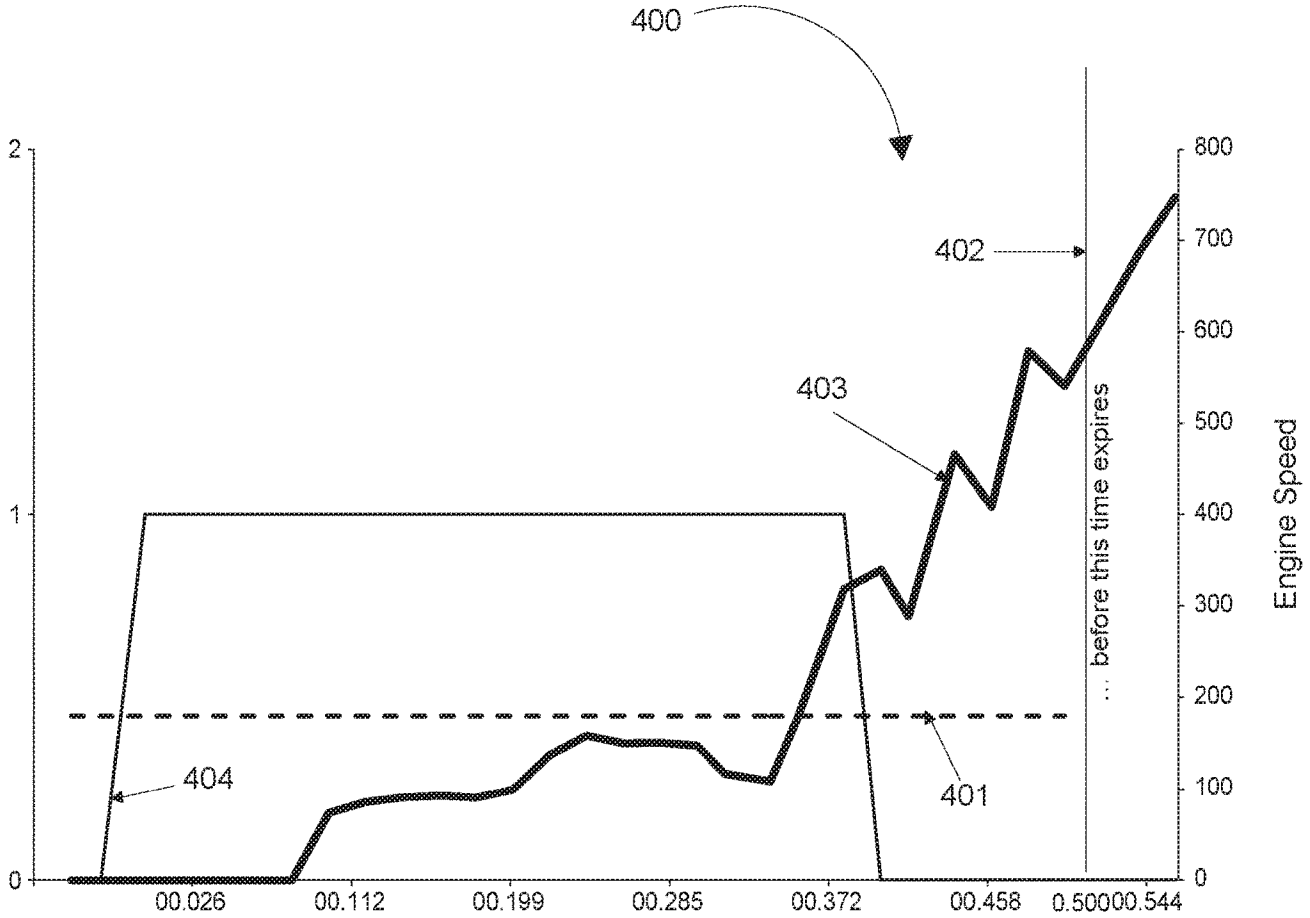
FIG. 4 is a graphical representation of an implementation of method 300 of FIG. 3, according to an example embodiment.

With process 300 in mind, an example iteration may be explained as follows in regard to graph 400 of FIG. 4. In FIG. 4, the fueling system engagement parameter is an engine speed of approximately 180 RPM (line 401) and the acceptable time threshold for reaching the predefined engine speed is 0.500 seconds (line 402). Line 403 is a line representing the engine speed as a function of time from the inception of the ignition command, while line 404 represents the starter or ignition command. This example is shown with the run condition parameter(s) being met and at time equal to zero, the ignition command is received. In other words and to summarize graph 400, an ignition command is received at time equal to zero seconds. The ignition command is provided and shown at line 404, which depicts operation of the starting system, particularly the starter motor, upon reception of the ignition command (i.e., the left hand axis that shows progression of the ignition command from "off" to "on"). At just prior to 0.372 seconds, the engine speed has surpassed the desired threshold. Almost contemporaneously, line 404 begins to descend towards the x-axis indicating disengagement of the starter motor (i.e., the "off" state). Further, the engine speed has surpassed the threshold before the time threshold of 0.500 seconds. Accordingly, for this particular instance, the diagnosis would correspond with a pass condition.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

Example and non-limiting circuit implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the circuit specification, any actuator including at least an electrical, hydraulic, or pneumatic actuator, a solenoid, an op-amp, analog control elements (springs, filters, integrators, adders, dividers, gain elements), and/or digital control elements.

The schematic flow chart diagrams and method schematic diagrams described above are generally set forth as logical flow chart diagrams. As such, the depicted order and labeled steps are indicative of representative embodiments. Other steps, orderings and methods may be conceived that are equivalent in function, logic, or effect to one or more steps, or portions thereof, of the methods illustrated in the schematic diagrams.

Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

Many of the functional units described in this specification have been labeled as circuits, in order to more particularly emphasize their implementation independence. For example, a circuit may be implemented as a hardware circuit comprising custom VLSI circuits or gate arrays, off-the-shelf semiconductors such as logic chips, transistors, or other discrete components. A circuit may also be implemented in programmable hardware devices such as field programmable gate arrays, programmable array logic, programmable logic devices or the like.

Circuits may also be implemented in machine-readable medium for execution by various types of processors. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit.

Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network. Where a circuit or portions of a circuit are implemented in machine-readable medium (or computer-readable medium), the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on the user's computer, partly on the user's computer, as a stand-alone computer-readable package, partly on the user's computer and partly on a remote computer or entirely on the remote computer or server.

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus, comprising: a fueling system engagement circuit structured to receive a fueling system engagement parameter for a vehicle, and an operating condition for the vehicle, wherein a fueling system for the vehicle takes over for a starting system of the vehicle during a transition from an off state to an on state of an engine of the vehicle when the operating condition meets the fueling system engagement parameter, a timer circuit structured to receive time data indicative of a time duration for the operating condition to meet the fueling system engagement parameter after an ignition command is received, wherein the ignition command is for turning the engine from the off state to the on state; and a diagnostic circuit structured to compare the time duration to an associated time threshold for the operating condition to meet the fueling system engagement parameter after the ignition command is received, and responsive to the comparison, diagnose the starting system for the vehicle by selectively turning an indicator light on.

2. The apparatus of claim 1, wherein the diagnostic circuit is further structured to provide the diagnosis to at least one of an external network and an input/output device of the vehicle.

3. The apparatus of claim 1, wherein the fueling system engagement parameter includes a predefined engine speed, wherein the associated time threshold includes a desired time duration to reach the predefined engine speed from receiving the ignition command.

4. The apparatus of claim 3, wherein the predefined engine speed includes any engine speed between 150 revolutions-per-minute and 200 revolutions-per-minute.

5. The apparatus of claim 1, wherein the fueling system engagement parameter includes a predefined starter motor speed of the starting system, wherein the associated time threshold includes a desired time duration to reach the predefined starter motor speed from receiving the ignition command.

6. The apparatus of claim 1, wherein the fueling system engagement parameter includes a switch to a fuel system controller from a starting system controller, wherein the associated time threshold includes a desired time duration from receiving the ignition command till occurrence of the switch.

7. The apparatus of claim 1, wherein the fueling system engagement parameter includes disengagement of an overrunning clutch of a starter motor in the starting system, wherein the associated time threshold includes a desired time duration for when disengagement of the overrunning clutch occurs from receiving the ignition command.

8. The apparatus of claim 1, further comprising a run condition circuit structured to receive a run condition defining when activation of the timer circuit and the diagnostic circuit is structured to occur.

9. The apparatus of claim 7, wherein the run condition includes at least one of a predefined engine temperature, a predefined charge level for a battery of the vehicle, a predefined environmental condition, and a user-defined run condition.

10. The apparatus of claim 1, wherein the diagnostic circuit includes confirmation logic, wherein the confirmation logic is structured to confirm the diagnosis.

11. The apparatus of claim 10, wherein the confirmation logic is structured to compare a number of occasions in which the time duration exceeds the associated time threshold to a predefined number of fails and responsive to the comparison, confirm that the starting system is faulty.

12. A method, comprising:

receiving a run condition parameter for a vehicle;

receiving an operating condition for the vehicle:

receiving a fueling system engagement parameter associated with the operating condition;

receiving an ignition command for turning an engine of the vehicle from an off state to an on state;

determining the run condition parameter is met based on reception of vehicle operation data;

responsive to the determination that the run condition parameter is met, receiving time data indicative of a time duration for the operating condition to meet the fueling system engagement parameter after receipt of the ignition command;

comparing the time duration to an associated time threshold for the operating condition to meet the fueling system engagement parameter after the ignition command is received; and responsive to the comparison, diagnosing a starting system of the vehicle by selectively turning an indicator light on.

13. The method of claim 12, wherein the run condition parameter includes at least one of a predefined engine temperature, and a predefined charge level for a battery of the vehicle, a predefined environmental condition, and a user-defined run condition.

14. The method of claim 12, wherein the fueling system engagement parameter includes a predefined engine speed, wherein the associated time threshold includes a desired time duration to reach the predefined engine speed from receiving the ignition command.

15. The method of claim 12, wherein the fueling system engagement parameter includes a predefined starter motor speed of the starting system, wherein the associated time threshold includes a desired time duration to reach the predefined starter motor speed from receiving the ignition command.

16. The method of claim 12, wherein the fueling system engagement parameter includes a switch to a fuel system controller from a starting system controller, wherein the associated time threshold includes a desired time duration from receiving the ignition command till occurrence of the switch.

17. The method of claim 12, wherein the fueling system engagement parameter includes disengagement of an overrunning clutch of a starter motor in the starting system, wherein the associated time threshold includes a desired time duration for when disengagement of the overrunning clutch occurs from receiving the ignition command.

18. A system, comprising: a controller structured to:

receive a run condition parameter for a vehicle;

receive an operating condition for the vehicle;

receive a fueling system engagement parameter associated with the operating condition;

receive an ignition command for turning an engine of the vehicle from an off state to an on state;

determine the run condition parameter is met based on reception of vehicle operation data;

responsive to the determination that the run condition parameter is met, receive time data indicative of a time duration for the operating condition to meet the fueling system engagement parameter from reception of the ignition command;

comparing the time duration to an associated time threshold for the operating condition to meet the fueling system engagement parameter after the ignition command is received; and responsive to the comparison, diagnosing a starting system of the vehicle by selectively turning an indicator light on.

19. The system of claim 18, wherein the run condition parameter includes at least one of a predefined engine temperature, and a predefined charge level for a battery of the vehicle, a predefined environmental condition, and a user-defined run condition.

20. The system of claim 18, wherein the controller is further configured to confirm the diagnosis.

* * * * *